US007762352B2

(12) United States Patent
Pettersson

(10) Patent No.: US 7,762,352 B2
(45) Date of Patent: Jul. 27, 2010

(54) ARRANGEMENT AND METHOD FOR CONTROLLING DRILLING PARAMETERS

(75) Inventor: Maria Pettersson, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 526 days.

(21) Appl. No.: 11/665,724

(22) PCT Filed: Nov. 29, 2005

(86) PCT No.: PCT/SE2005/001790

§ 371 (c)(1),
(2), (4) Date: Apr. 18, 2007

(87) PCT Pub. No.: WO2006/062460

PCT Pub. Date: Jun. 15, 2006

(65) Prior Publication Data

US 2009/0044976 A1 Feb. 19, 2009

(30) Foreign Application Priority Data

Dec. 10, 2004 (SE) ..... 0403009

(51) Int. Cl.
*E21B 44/04* (2006.01)

(52) U.S. Cl. ..... 175/24; 175/40; 173/5

(58) Field of Classification Search ..... 175/24, 175/26, 40; 173/2, 5, 11, 13
See application file for complete search history.

(56) References Cited

U.S. PATENT DOCUMENTS 3,581,830 A * 6/1971 Stoner ..... 173/6
3,670,826 A 6/1972 Hanson et al.
4,299,294 A * 11/1981 Womack ..... 173/148
4,685,329 A 8/1987 Burgess
5,449,047 A 9/1995 Schivley, Jr.
5,507,353 A 4/1996 Pavone
6,253,860 B1 7/2001 Poysti et al.
6,419,031 B1 7/2002 Poysti
6,505,689 B1 1/2003 Poysti et al.

FOREIGN PATENT DOCUMENTS

| | | |
|---|---|---|
| CA | 2293643 | 12/1998 |
| CA | 2389218 | 5/2001 |
| EP | 0112810 | 7/1984 |
| EP | 0564504 | 8/1996 |
| WO | 9749895 | 12/1997 |
| WO | 03044319 | 5/2003 |

* cited by examiner

*Primary Examiner*—Daniel P Stephenson
(74) *Attorney, Agent, or Firm*—Mark P. Stone

(57) ABSTRACT

The present invention relates to a method and an arrangement for controlling drilling parameters when rock drilling. The arrangement is arranged such that a drill tool is connectable to a drilling machine by means of one or more drill string components, wherein the arrangement comprises means for rotating the drill tool during rock drilling and for providing a tightening torque for tightening joints between one or more from the group: drill tool, one or more drill string components and drilling machine. The arrangement is arranged to control the rotational speed of the drill tool based on available tightening torque.

11 Claims, 2 Drawing Sheets

ARRANGEMENT AND METHOD FOR CONTROLLING DRILLING PARAMETERS

FIELD OF THE INVENTION

The invention relates to an arrangement and a method for controlling drilling parameters during rock drilling.

BACKGROUND OF THE INVENTION

A drill tool connected to a drilling machine by means of one or more drill string components is often used at rock drilling. The drilling may be performed in a number of ways, e.g., as rotational drilling, wherein the drill tool is pushed towards the rock using high pressure and then crushes the rock using hard metal elements, e.g., made from wolfram carbide. Another way of performing rock drilling is to use percussive drilling machines, wherein the drill string is provided with a drill steel shank at which a piston impacts to transfer impact pulses to the drill tool through the drill string and then further onto the rock. Percussive drilling is combined with a rotation of the drill string in order to achieve a drilling wherein the drill elements of the drill bit hits new rock at each impact, (e.g., does not hit a hole generated by the previous impact), which increases drilling efficiency.

A problem using rotational drilling is that in certain conditions, the drill bit (the drill bit elements of the drill bit) may "get stuck" in the rock, whereby the rotation of the drill bit stops at the same time as the drill string continues to rotate due to system inertia. This results in a torsion oscillation in the drill string, which, in turn, is the source of a loosening (releasing) force, which tends to loosen (release) joints of the drill tool and/or drill string and or drilling machine, as these joints usually consist of threaded joints which may unthread by the loosening force. This loosening of joints causes damaging heat generation and damages threads.

OBJECT OF THE INVENTION AND ITS MOST IMPORTANT FEATURES

It is an object of the present invention to provide an arrangement for controlling drilling parameters that solves the above mentioned problem.

Another object of the present invention is to provide a method for controlling drilling parameters that solves the above mentioned problem.

These and other objects are accomplished according to the present invention by an arrangement for controlling drilling parameters as defined in claim 1 and by a method as defined in claim 6.

According to the present invention, the above objects are accomplished by an arrangement for controlling drilling parameters during rock drilling, wherein the arrangement is arranged such that a drill tool is connectable to a drilling machine by one or more drill string components. The arrangement comprises means, e.g., a rotation motor, to rotate the drill tool during drilling and provide a tightening torque for tightening joints between one or more from the group: drill tool, one or more drill string components and a drilling machine. The arrangement is arranged to control the rotational speed of the drill tool based on available tightening torque.

This has the advantage that, when the tightening torque that is required to keep the joints together is dependent on rotational speed, the rotational speed of the drill string may be lowered such that the available tightening torque also becomes a sufficient tightening torque for keeping the joints together.

Further, this has the advantage that the present invention is well adapted for so called start-up drilling, or collaring. Since a reduced feed force is used during start-up drilling, this also affects the available tightening torque, since tightening torque is dependent of feed force. Usually, a rotational speed is set, which is adjusted to the percussion pressure during full drilling, which, in turn, usually is used together with the feed pressure used during full drilling. This rotational speed will thus be based on a determined available tightening torque that is considerably greater than during start-up drilling, which increases the risk that a loosening torque will occur according to the above, whereby damages on the drill string may occur. Using the present invention, on the other hand, the rotational speed may be lowered and adjusted to an available tightening torque, which thus allows the avoidance of loosening and damages dependent thereon.

The available rotational torque may be obtained as a function of rotation pressure. This has the advantage that the available tightening torque may be obtained in a simple manner.

The arrangement may further comprise feed means for pressing the drill tool against a surface, wherein the arrangement may further be arranged to increase/decrease available tightening torque by increasing/decreasing the feed pressure.

The arrangement may further be arranged to obtain the rotation pressure continuously and/or at certain intervals by sensoring, monitoring, measurement or calculation, and compare the obtained rotation pressure with the rotation pressure that is required at the current rotational speed of the drill tool, and lower the rotational speed of the drill tool if the current pressure is lower than the required. The comparison may be performed using a relation between the required rotation pressure and the rotational speed of the drill tool and/or by a table look-up in a table comprising a relation between required rotation pressure and the rotational speed of the drill tool.

This has the advantage that at all times during the drilling process it may be ensured that the rotational speed is not too high in relation to the rotation pressure.

The arrangement may further be arranged to use the feed pressure when controlling the rotational speed.

The present invention further relates to a suchlike method, whereby advantages corresponding to the above described will be obtained.

Further advantages will be obtained by various aspects of the invention and will be apparent from the following detailed description.

DETAILED DESCRIPTION OF PREFERRED EMBODIMENTS

Figure 1:
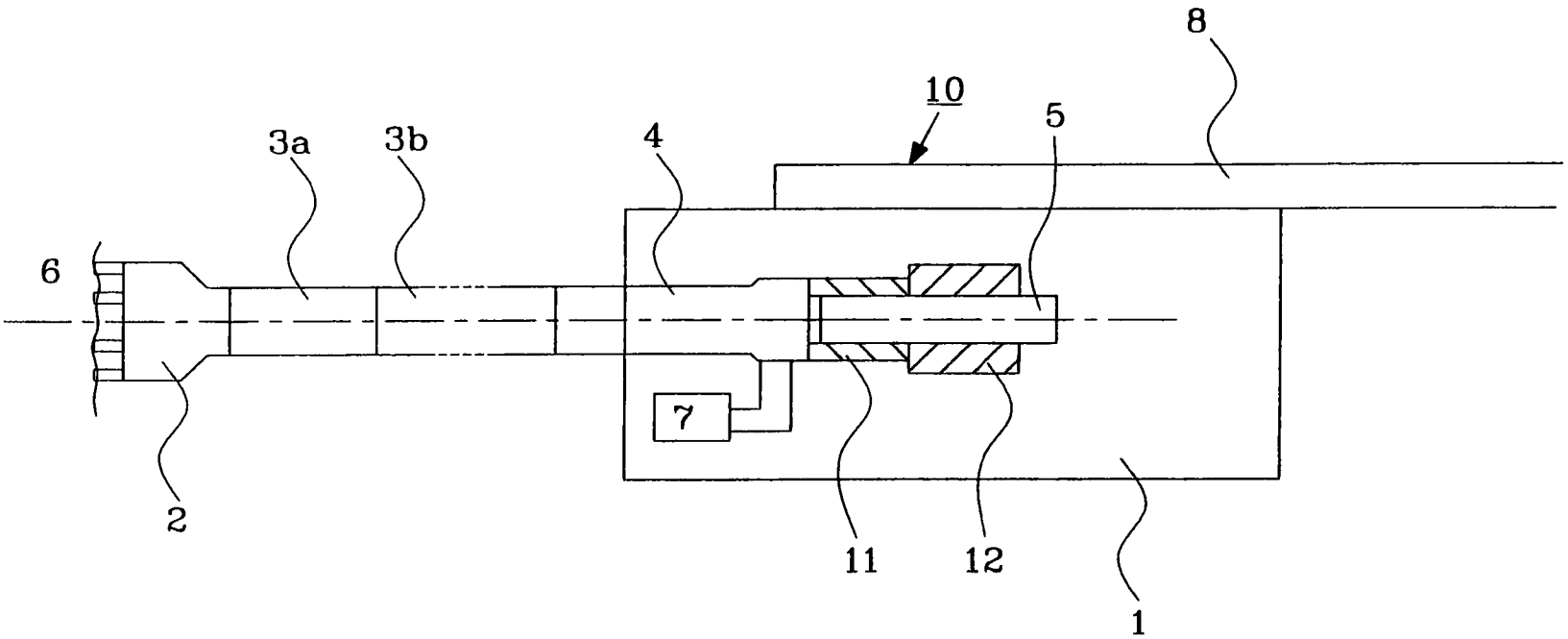
FIG. 1 shows an example of a drilling machine wherein the present invention may be utilised.

In FIG. 1 is shown an exemplary rock drilling apparatus 10 wherewith the present invention may be utilised. The arrangement comprises a drilling machine 1 which, in operation, is connected to a drill tool such as a drill bit 2 by means of a drill string 3 consisting of one or more drill string components 3*a*, 3*b*, wherein the drill string component closest to the drilling machine constitutes an adapter 4 arranged within the machine. The drilling machine further comprises a hammer piston 5 which is reciprocatable movable in the axial direction of the drill string 3. During drilling, energy is transferred from the hammer piston 5 to the drill string 3 via the adapter 4 and then from drill string component to drill string component and finally to the rock 6 by the drill bit 2.

Apart from the fact that the drill bit 2 is subjected to impact pulses, it is rotated in order for the drill bit to always hit fresh rock, which increases the efficiency of the drilling. The drill bit 2 is rotated using the drill string 3, which in turn is preferably rotated by a rotation motor 7.

The rock drilling machine 1 is further movable along a feed beam 8 by means of a feeder motor or cylinder in a conventional manner using, e.g., a chain or wire in order to at all times press the drilling machine 1 towards the rock 6 at all times. In order to prevent the drill string component 3*a*, 3*b* joints from releasing (loosening) during drilling, the drilling machine 1 further comprises a bushing 11 that by means of a piston is pushed towards the adapter 4 and thereby the drill string 3 so that the drill bit will have a better contact with the rock 6 and, e.g., will not hang free in air when the percussion device impact occurs. The piston 12 may also be used to dampen reflexes from the drill bit 2 rock impacts.

During drilling, a rotation speed is set for the drill string 3, and thereby the drill bit 2. It is possible to adjust the rotation speed according to the percussion device frequency all the time, such that the drill bit elements of the drill bit end up at a desired position all the time irrespective of the percussion device frequency. For example, the drill bit may, at a next impact, at all times hit between the bit positions of a previous impact.

The required number of revolutions, n, (i.e., the rotational speed) to obtain a desired indexing, z, of the periphery of the drill bit (bit diameter D) may be calculated from the following equation:

$$n = \frac{z}{\pi D} \cdot f \cdot 60 \text{ [rpm]},$$

wherein f is the impact frequency. The number of revolutions according to the equation may be reduced if the wear of the bit becomes too great. Usually, there is no speed change when changing the percussion pressure, since the percussion frequency only depends on the square root of the percussion pressure. Instead, a number of revolutions according to the above equation is calculated for the highest percussion pressure that is used, and thereby associated percussion frequency.

During drilling, the size of the rotational torque of the drill string is decisive as to whether the drill string component joints will be tight enough or not. Usually, the rotation pressure is used to calculate the rotational torque. However, if a sufficient tightening torque can not be obtained using rotation pressure (the required tightening torque is affected, apart from the rotational speed, also by the rock and the bit), the feed force may be increased to obtain a sufficient torque.

During certain conditions, the required tightening torque is not sufficient to ensure that the drill string joints are tightened, and the joints therefore may loosen.

According to the present invention, this is solved by reducing the rotation speed such that it is adjusted to the available tightening torque.

An example of a situation wherein the tightening torque may not be sufficient is, as has been mentioned before, during so called start-up drilling or collaring. It is important that the start-up is performed in a correct manner, since this is when the direction of the hole is determined. Both incorrectness's in direction and possible bending results in a large deviation which in turn results in a large load on the drilling equipment, and more difficult blasting conditions.

In order to obtain a satisfying start-up drilling to ensure that the hole ends up in a desired position and has a correct direction it is, among other, desired to drill the first portion of the hole using a reduced feed force in order to avoid that the drill steel slips on surface of the rock, which often is uneven and inhomogeneous, e.g., due to previous blasting. Accordingly, it is not possible during start-up drilling to arbitrarily increase the feed force without risking the drill hole positioning/direction.

For an exemplary drilling machine, the feed pressure during start-up drilling may, e.g., start at 130 bars to increase to 200 bars during full drilling. When the start-up drilling is performed using a drill string rotation speed that is calculated on the basis of the highest feed pressure, and thereby high impact frequency, there is a substantial risk that the drill tool gets stuck and, due to the previously mentioned torsional rotation, a loosening torque that is greater than the available tightening torque arises, which may result in loosening of joints with damaging heat generation and damaged threads as a consequence.

During start-up drilling it is not necessary that the drill bit is rotated by a speed that is adjusted to an optimal penetration rate, it is more important that the drilling is performed in a secure manner. Consequently, using the present invention, the rotational speed may be adjusted to the available tightening torque.

Figure 2:
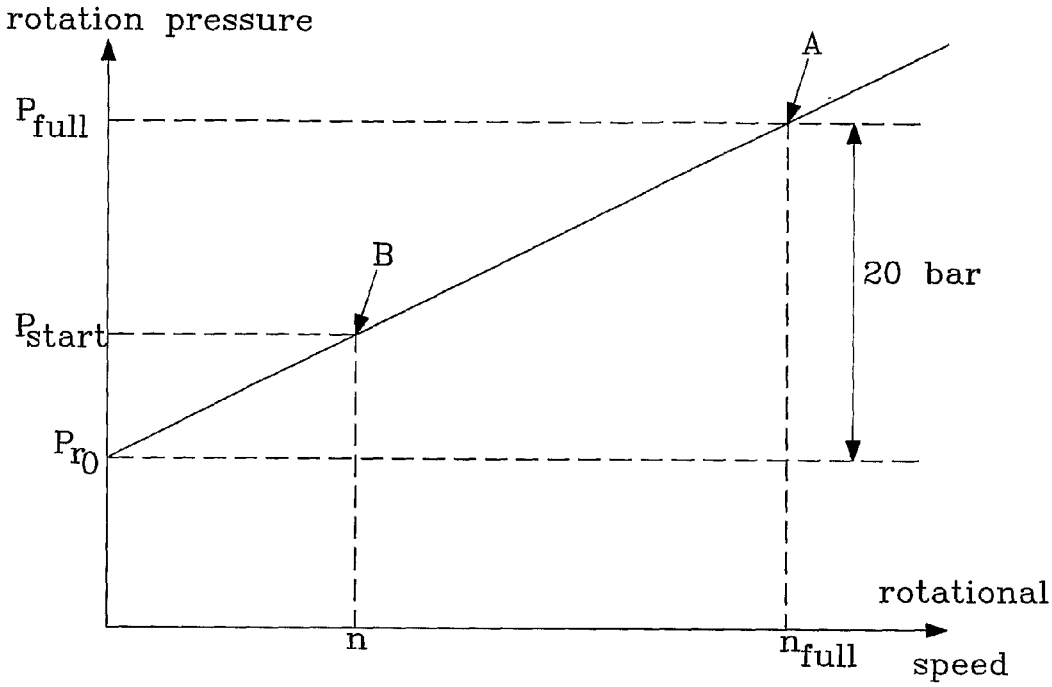
FIG. 2 shows a graph of the relation of required rotation pressure and rotational speed.

In FIG. 2, a graph of the required rotation pressure increase as a function of the rotational speed is shown. As can be seen in the graph, there is a relationship between rotation pressure (and thereby rotational torque) and the rotational speed. $p_{r0}$ denotes the no-load rotation pressure required to rotate the drill string when the drill bit is not in contact with the rock and is, among other, caused by friction in motor, gear box, etc. In the graph, the point A denotes the rotation speed $n_{full}$ and rotation pressure $p_{full}$ that is determined for the exemplary drilling machine at the highest pressure used, e.g., 200 bar. As is shown in the figure, this rotation pressure is greater than the rotation pressure $p_{start}$ that is available at start-up drilling, when the maximum feed pressure can not be used without risking that a problem with the direction/position of the hole arises. If thus $n_{full}$ is used during start-up drilling, there is a big risk that the joints are loosened with the above problem as result. If, on the other hand, the rotation speed is lowered to what is denoted by the point B in FIG. 2, the drill string may be rotated using a rotation pressure/tightening torque that is sufficient to keep the joints together, since the required rotation pressure is lower than what is available. As is shown in FIG. 2, the difference between the no-load pressure and the rotation pressure at highest speed may be 20 bar. This pressure, however, is only exemplary and may, of course, be whatever is appropriate for the specific drilling equipment(s) wherein the present invention is to be implemented.

Figure 3:
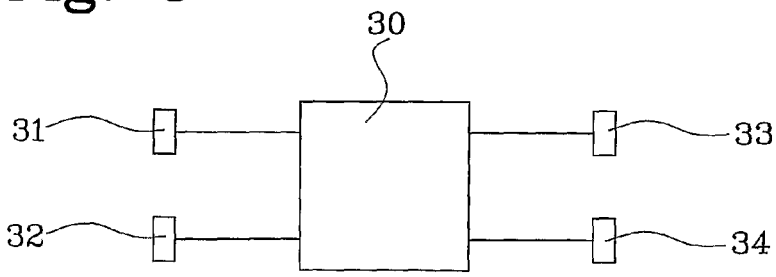
FIG. 3 shows a control system according to the present invention.

In FIG. 3 is shown a control system for controlling the rotation speed. The control system comprises a control unit 30 to which a sensor 31 for the rotation motor 7 pressure and a sensor for the drill string rotation speed may be connected. The rotation speed of the drill string may, e.g., be represented by the flow through the rotation motor or be obtained through direct measurement of the rotation of the drill string. Alternatively, the rotational speed may be represented by the voltage of the rotation motor. A certain voltage normally results in a certain rotational speed, which in turn results in a certain flow. By measuring the voltage the flow may thus be estimated, which has the advantage that a flow meter is not necessary for this purpose. The control unit 30 may further be arranged to control a number of valves 33, 34, which for example may control the flow through the rotation motor 7 and the feed pressure. Alternatively, the control unit may be arranged to provide values to a further control unit, which in turn controls various pressures.

The control is performed by obtaining the current rotational speed and rotation pressure, e.g., by measurement, sensoring or monitoring. The measured rotation pressure is then compared with a predetermined relation between rotation pressure and rotational speed, as the one shown in the graph in FIG. 2. The comparison may, e.g., be performed by a table look-up, in which is stored required rotation pressure for various rotational speeds. Based on the comparison, the flow through the rotation motor 7, and thereby rotational speed, may be controlled. Instead of using a table look-up, a mathematical relationship between rotational speed and required rotation pressure may be used to calculate required rotation pressure.

If the maximum rotation pressure is not sufficient to ensure that the drill string joints are kept together, the control unit may increase the feed pressure to thereby increase the rotation pressure. If, on the other hand, the rotation pressure already is at a maximum, or if any feed pressure restriction is present, such as, e.g., during start-up drilling, the rotational speed may be lowered instead. The control unit may control the feed pressure either by directly controlling a valve 34 that controls flow and pressure to the feed motor/cylinder, or by providing values to a further control unit which in turn controls pressure/flow to the feed motor/cylinder. If the present invention is used during start-up drilling wherein the percussion pressure and feed pressure transitions from a first reduced level to substantially full drilling level, the available feed pressure is changing all the time, whereby the rotational speed may also be changing (increasing) all the time in accordance therewith.

The present invention has been described above in connection with start-up drilling. The invention, however, is also applicable at normal drilling. If, for example, the rock contains a lot of cracks or if the hardness of the rock varies substantially, situations may occur wherein the available tightening torque is not sufficient to ensure that the joints between drill bit/drill string components/drilling machine are kept together. Using the control principle according to the present invention, the rotational speed is immediately decreased, so that the required tightening torque is decreased. For example, the rotational speed may, at such an occasion, be reduced to precisely the rotational speed that corresponds to the available tightening torque.

The present invention has been described above with reference to a specific kind of drilling machine. The invention may, of course, be used in other kinds of drilling machines, for example, drilling machines without damper and bushing.

The invention claimed is:

1. Arrangement for controlling drilling parameters during rock drilling, wherein the arrangement is arranged such that a drill tool is connectable to a drilling machine by means of one or more drill string components, wherein the arrangement comprises means for rotating the drill tool during drilling and for providing a tightening torque for tightening joints between one or more from the group: drill tool, one or more drill string components and drilling machine, characterised in that the arrangement is arranged to control the rotational speed of the drill tool based on available tightening torque.

2. Arrangement according to claim 1, characterised in that said means consists of a rotation motor.

3. Arrangement according to claim 2, characterised in that it is arranged to obtain the available rotational torque as a function of rotation pressure.

4. Arrangement according to claim 3, characterised in that it further is arranged to:

continuously or at certain intervals obtain the rotation pressure by sensing, monitoring, measuring or calculating, and compare the obtained rotation pressure with the rotational speed of the drilling machine, and decrease the rotational speed of the drill tool if the current pressure is lower than the required pressure.

5. Arrangement according to claim 4, characterised in that it further is arranged to perform the comparison using a relation between the required rotation pressure and the rotational speed of the drill tool or by a table look-up, said table comprising a relation between required rotation pressure and the rotational speed of the drill tool.

6. The arrangement according to claim 5, wherein said relation is a mathematic relation.

7. Method for controlling drilling parameters during rock drilling, wherein a drill tool is connectable to a drilling machine by means of one or more drill string components, wherein the drill tool is rotated during drilling and a tightening torque is provided for tightening joints between one or more from the group: drill tool, one or more drill string components and drilling machine, characterised in the step of controlling the rotational speed of the drill tool based on available tightening torque.

8. Method according to claim 7, characterised in that the available rotational torque is obtained as a function of rotation pressure.

9. Method according to claim 8, characterised in the further steps of:

continuously or at certain intervals obtaining the rotation pressure by sensing, monitoring, measuring or calculating, and:

comparing the obtained rotation pressure with the rotation pressure that is required at the current rotational speed of the drilling machine, and decreasing the rotational speed of the drill tool if the current pressure is lower than the required pressure.

10. Method according to claim 9, characterised in the step of performing the comparison using a relation between the required rotation pressure and the rotational speed of the drill tool or by look-up in a table comprising a relation between required rotation pressure and the rotational speed of the drill tool.

11. The method according to claim 10, wherein said relation is a mathematic relation.

* * * * *